US006196143B1

(12) United States Patent
Post

(10) Patent No.: US 6,196,143 B1
(45) Date of Patent: Mar. 6, 2001

(54) CLIP HAVING SLOPED SIDES

(75) Inventor: Joseph R. Post, Canandaigua, NY (US)

(73) Assignee: Powerhouse Technology, Inc., Farmington, NY (US)

( * ) Notice: Subject to any disclaimer, the term of this patent is extended or adjusted under 35 U.S.C. 154(b) by 0 days.

(21) Appl. No.: 09/471,864

(22) Filed: Dec. 23, 1999

(51) Int. Cl.[7] ..... F23K 3/08; F23H 17/00; F23H 7/14

(52) U.S. Cl. ..... 110/268; 110/327; 110/328; 126/168; 126/175

(58) Field of Search ..... 110/327, 328, 110/268; 126/174, 175, 157, 168

(56) References Cited

U.S. PATENT DOCUMENTS

| | | | | |
|---|---|---|---|---|
| 403,416 | | 5/1889 | Campbell . | |
| 791,890 | * | 6/1905 | Fletcher | 126/168 |
| 945,574 | * | 1/1910 | Mcnaughton | 126/168 |
| 1,075,874 | * | 10/1913 | Thomas | 126/168 |
| 1,339,531 | | 5/1920 | Wallen . | |
| 1,784,772 | * | 12/1930 | Ziegler | 110/327 |
| 1,917,652 | | 7/1933 | Krieger . | |
| 2,955,812 | | 10/1960 | Boron . | |
| 4,200,047 | | 4/1980 | Knorr . | |
| 5,551,356 | | 9/1996 | Post . | |
| 5,766,001 | | 6/1998 | Bentsen . | |
| 5,839,376 | | 11/1998 | Barlow . | |

FOREIGN PATENT DOCUMENTS

| | | | | |
|---|---|---|---|---|
| 11217 | * | of 1892 | (GB) | 126/168 |
| 481245 | * | 3/1938 | (GB) | 110/328 |

OTHER PUBLICATIONS

"Riley Spreader Stoker Operating Instructions & Parts Catalog" a publication by the Riley Stoker Corporation, Worcester, MA (date unknown) pp. 8–10 and Dwg. 5KT–541–3.

* cited by examiner

*Primary Examiner*—Denise L. Ferensic
*Assistant Examiner*—K. B. Rinehart
(74) *Attorney, Agent, or Firm*—Greenwald & Basch; Dauane C. Basch

(57) ABSTRACT

The present invention is an apparatus for use as a grate clip on a traveling stoker grate assembly in a furnace or incinerator. The grate clip apparatus includes a sloping profile along a significant portion of its underside so as to prevent the build-up of ash, fuel and metallic deposits on the grate clip as it traverses a return loop.

19 Claims, 3 Drawing Sheets

CLIP HAVING SLOPED SIDES

GRATE CLIP HAVING SLOPED SIDES

This invention relates generally to a grate clip for use with a stoker grate, and more particularly to a grate clip having a sloping underside so as to prevent the build-up of ash, fuel and metallic deposits on the grate clip underside as the grate clip traverses a return loop.

BACKGROUND AND SUMMARY OF THE INVENTION

The present invention is a grate clip for use with a stoker grate, for example in a power generator, refuse incinerator or cooling device, and more particularly a slope-sided grate clip having sloping sides so as to shed ash and debris when traveling in an inverted orientation on a return loop of a stoker grate.

Heretofore, a number of patents and publications have disclosed grates and grate clips, the relevant portions of which may be briefly summarized as follows:

U.S. Pat. No. 403,416 to Campbell, issued May 14, 1889, discloses an inclined coal grate. The inclined grate included removable shelves held in place by gravity during reciprocation of adjacent U.S. Pat. No. 1,339,531 to Wallen, issued May 11, 1920, teaches a mechanical stoker including means to prevent the leakage of air about the ends of grate bars in a traveling grate.

U.S. Pat. No. 1,917,652 to Krieger, issued Jul. 11, 1933, discloses an automatic stoker wherein a traveling grate is employed that uniformly distributes air to the fuel bed, while preventing ash and fuel from sifting through to the air compartment there beneath. The grate clips are affixed to and supported by a series of parallel grate supporting bars, and the fuel is supported on the upper surface of the grate clips.

U.S. Pat. No. 2,955,812 to Boron, issued Oct. 11, 1960 describes a furnace pallet as a replacement to furnace grates that tend to crack, warp and burn out as higher furnace temperatures are used for processing ore.

U.S. Pat. No. 4,200,047 to Knorr, issued Apr. 29, 1980 discloses a two-part grate, having separable front and rear parts, for use in a reciprocating grate system.

U.S. Pat. No. 5,766,001 to Bentson, issued Jun. 16, 1998, describes a grate element formed in the shape of a box and having an L-shaped cross section, wherein the design of the grate element leads a cooling gas through the grate element.

U.S. Pat. No. 5,839,376 to Barlow, issued Nov. 24, 1998, hereby incorporated by reference, teaches a stoker with a universal key construction so as to eliminate the need for distinct overlapping and underlapping keys.

U.S. Pat. No. 5,551,356, for a "TWO PIECE GRATE CLIP FOR USE AS A POWER GENERATOR MAINTENANCE PART," issued Sep. 3, 1996 to Joseph R. Post, is hereby incorporated by reference for its teachings relevant to grate stokers and grate clips.

In "Riley Spreader Stoker Operating Instructions & Parts Catalog" a publication by the Riley Stoker Corporation, Worcester, Mass. (date unknown) pp. 8–10 and Dwg. 5KT-541-3, shows that grate clips traverse a lower return loop of the stoker grate in an inverted position.

Prior art grates, including two part grate clips and also one piece grate clips, are typically connected to the stoker grate with a fastening means such as a bolt or a rigid T-bar support unit. In continuous loop grate systems, the underside of each grate clip is a location where ash, fuel and other debris tends to collect when it falls through the separations between the grate clips. Moreover, low melting point metals (e.g., Al, Pb, etc.), when exposed to the combustion temperatures of a furnace, often melt and drip through the grate clips only to collect on the underside of the return loop of the grate stoker. Build-up of the ash, debris and molten metal deposits requires frequent maintenance or replacement of the grate clips and other stoker hardware. Replacement of the broken or missing grate clips often requires the furnace to be turned off and the stoker to be idled. Because shutting down a furnace is costly, it is desirable to avoid or reduce or eliminate the need to clean or replace damaged grate clips.

In accordance with the present invention, there is provided a grate clip for a traveling stoker grate. comprising a centrally located supporting boss for operatively connecting the clip to a supporting member of the stoker grate, a generally planar fuel-supporting portion along an upper surface thereof, and a slope-sided lower surface, wherein the sloped-sided lower surface is generally free of surfaces that are parallel to the planar fuel-supporting portion along the upper surface.

In accordance with another aspect of the present invention, there is provided a grate clip for a traveling stoker grate, comprising a first elongated flange piece having a generally planar fuel-supporting portion along an upper surface thereof and a slope-sided lower surface and a threaded opening in the body parallel to the fuel supporting surface, wherein the sloped-sided lower surface is generally free of surfaces that are parallel to the planar fuel-supporting portion, a second elongated flange piece having a body with an upper fuel supporting surface, coplanar with the fuel supporting surface of the first piece when the clip is assembled and a slope-sided lower surface, wherein the sloped-sided lower surface is generally free of surfaces that are parallel to the planar fuel-supporting portion, a bore extending through the body of the second piece parallel to the fuel supporting surface and aligned with the threaded opening when the clip is assembled, the first piece having a transverse notch and the second piece having a transverse notch forming a T-shaped transverse notch when the clip is assembled, and a fastener extending through the bore and into the threaded opening parallel to the fuel supporting surface.

In accordance with yet another aspect of the present invention, there is provided a traveling stoker grate, comprising a plurality of grate clips, and a transport assembly, operatively associated with said grate clips, for moving said grate clips in a continuous loop, wherein at least one of said plurality of grate clips includes a centrally located supporting boss for operatively connecting the clip to the transport assembly, a generally planar fuel-supporting portion along an upper surface thereof, and a slope-sided lower surface, wherein the sloped-sided lower surface is generally free of surfaces that are parallel to the planar fuel-supporting portion along the upper surface.

One aspect of the invention is based on the discovery that the reduction or elimination of horizontal surfaces on the underside of the grate clips reduces the locations in which debris, fuel and molten materials collect and/or solidify. This discovery avoids problems that arise in continuous stoker grates, where a return loop of the grate clips or keys passes beneath an upper plane that supports fuel for combustion. This aspect of the invention can be implemented, for example, by providing a continuously sloped surface on the majority of the underside of the grate clips, thereby shedding the materials that fall or drip through the top of the grate stoker.

The technique described above is advantageous because it is easily applied to the casting or molding techniques for new or replacement grate clips. Moreover, the improved design does not change the functionality of the clip or significantly alter the amount of material used to manufacture it. Hence, the improved design is inexpensive in terms of overall cost when compared to other approaches used to clean the grate stoker, and will likely improve the life of the grate clips and stoker equipment.

Figure 1:
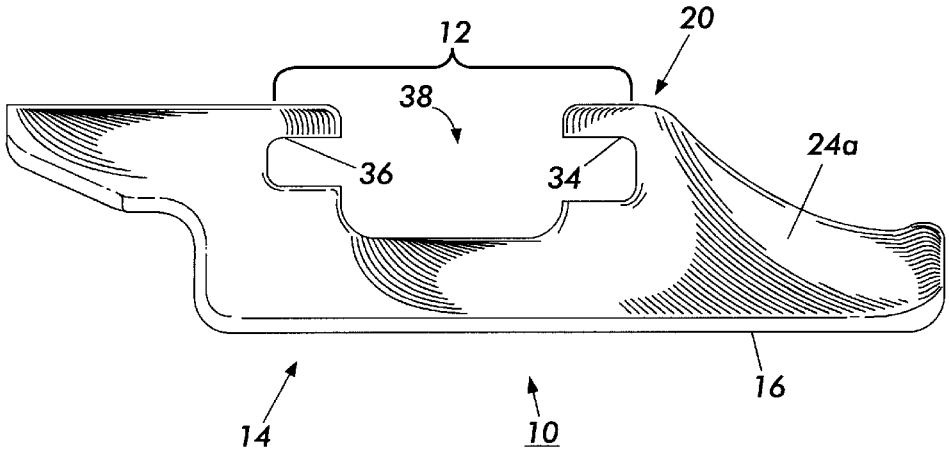
FIG. 1 is a side view of an illustrative embodiment in accordance with the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements.

Referring to FIGS. 1–4, there are depicted therein various side and bottom views of an illustrative embodiment of grate clip 10. Grate clip 10 includes a centrally located supporting boss 12 for operatively connecting the clip to a supporting member of the grate stoker (150 in FIG. 6), and an upper surface 14 that has a fuel-supporting portion 16 along a portion of the upper surface. Grate clip also has a lower surface 20 that incorporates boss 12 and extends the entire length of grate clip 10.

Figure 2:
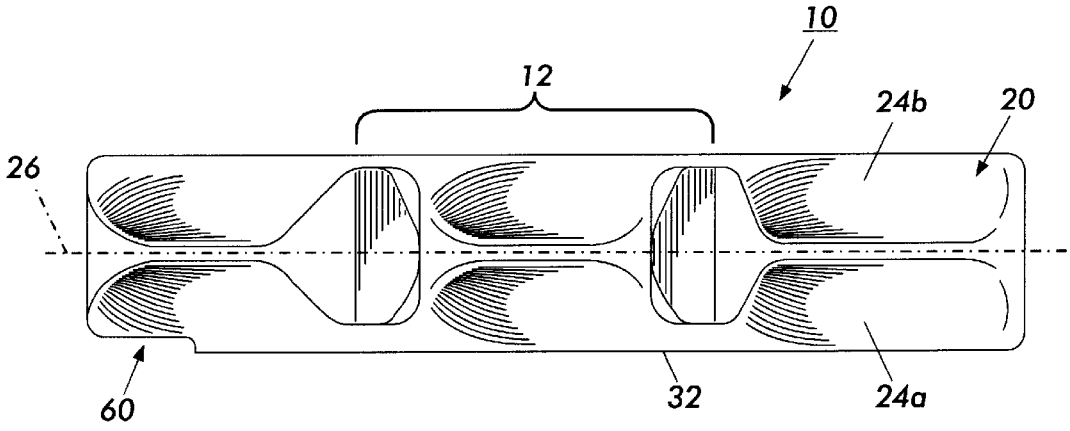
FIG. 2 is a top view of an illustrative embodiment in accordance with the present invention.
Figure 3:
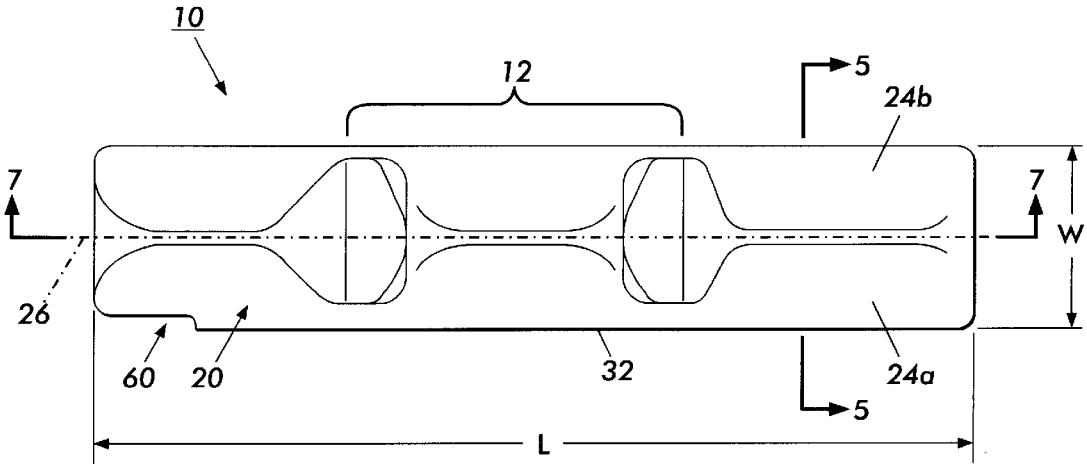
FIGS. 3 and 4 are, respectively, bottom and side orthographic projections of a design of the present invention.
Figure 4:
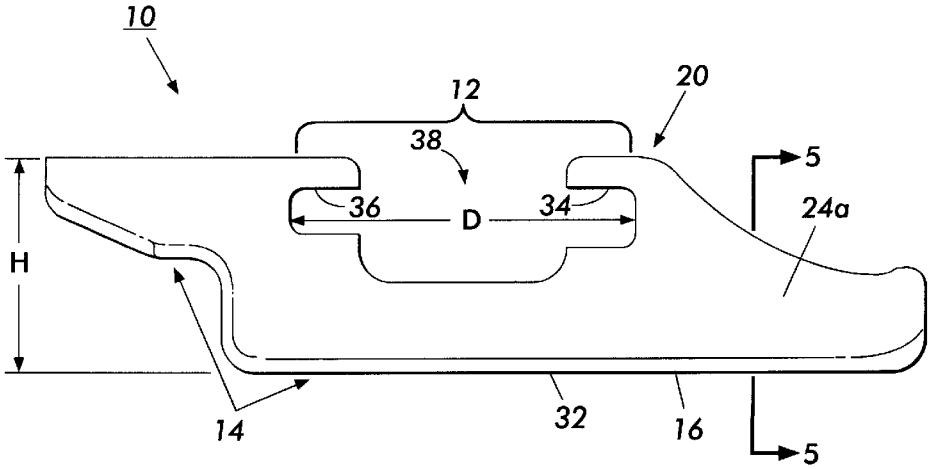

As depicted in FIGS. 1–4, lower surface 20 incorporates sloped sides 24*a* and 24*b*. In a preferred embodiment, sides 24*a* and 24*b* are both at a maximum thickness, relative to upper surface 14, along a longitudinal, vertical plane indicated in the figures by dashed line 26. From the maximum thickness along the longitudinal plane, and proceeding in a direction orthogonal thereto, the sides are continuously sloped at an acute angle relative to the generally planar upper surface 14 so as to prevent the collection of ash, debris and molten materials (e.g., Al, Pb, etc.) on the surface when the grate clip is oriented in an inverted position as depicted in FIGS. 2 and 4.

Figure 6:
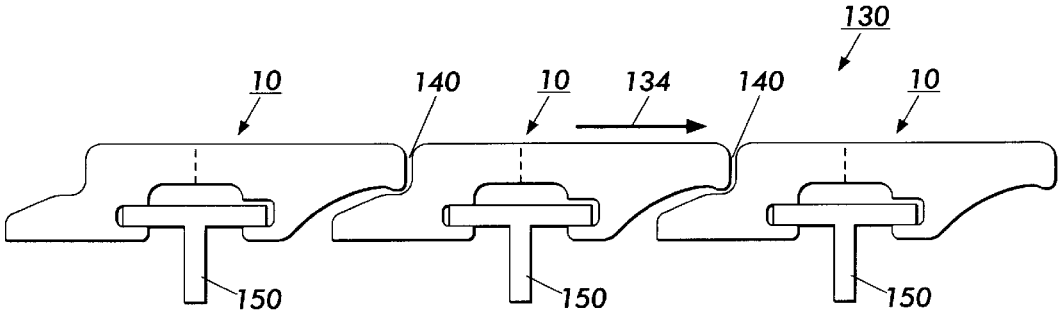
FIG. 6 is an orthographic view of the side of a portion of a stoker grate assembled in accordance with the present invention.

Supporting boss 12 preferably includes corresponding transverse notches 34 and 36 that form a T-shaped transverse notch 38. Referring briefly to FIG. 6, the T-shaped transverse notch 38 allows the grate clip to be mounted onto a grate bar support 150 that not only holds the grate clip in place relative to adjacent grate clips, in both the lateral (not shown) and longitudinal directions.

Referring specifically to FIGS. 2–5, which depict an exemplary configuration for the present invention, the overall length of the gate clip, as represented by reference letter L, is within the range of 171–191 mm, and preferably about 181 mm. The width of the clip, as represented by reference letter W is in the range of 28.1–48.1 mm, and is preferably about 38.1 mm. The height of the grate clip, extreme bottom surface to planar top portion, as represented by reference numeral H, is in the range of 34.5–54.5 mm, and is preferably about 44.5 mm.

Support boss region 12 is ideally narrower than the overall width W, and preferably on the order of 30.0 mm in width. The spacing between the opposing sides of support boss 12 are, as will be appreciated, a function of the width of the T-bar support and the desired depth of the notches 34 and 36 that form the transverse notch. In a preferred embodiment the transverse is slightly oversized to allow the grate clip to slide on the T-bar support, and preferably the distance D between the ends of notches 34 and 36 is on the order of 71.4 mm. Also, notches 34 and 36 are of slightly different heights, where the notch for the lead edge 34 is on the order of 12.7 mm in height and the notch for the trail edge is on the order of 9.5 mm high. Referring specifically to FIG. 3, the outer edge of grate clip 10 includes a notch 60 to provide a path for air flow through the surface of the stoker grate.

Although it is possible to use a number of materials, including ceramics to construct the grate clips, it is generally desirable to use metallic alloys suitable for the temperatures at which an operator will use the grate stoker. Preferably a material from the family of cast irons is selected, and a manufacturing process that includes casting is employed. The material used for casting can include ductile iron, as well as alloys including but not limited to Stainless Steel. Although various alternatives and alloys are possible, the preferred alloys are type HH Stainless, Type ASTMA-319 with 1% Chromium (Cr), and ductile alloys in the ASTMA 536 category, including Type 65-45-12 Ductile and Type 80-55-06 Ductile, preferably with Silicon (Si) and Molybdenum (Mo) added to provide elevated thermal stability. As will be appreciated by those knowledgeable in the relative properties of metallic alloys, the particular material selected is dependent upon the operating conditions of the furnace and the longevity desired for the stoker grate clips.

Figure 5:
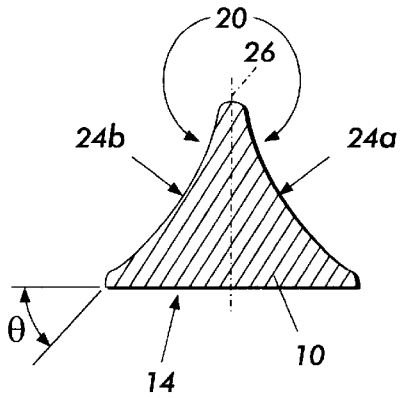
FIG. 5 is a cross sectional view of an aspect of the design depicted in FIGS. 3 and 4.

Turning to FIG. 5, a cross section of the grate clip as indicated in FIGS. 3 and 4, illustrates the sloping sides or surfaces 24*a* and 24*b*. As previously described, the preferred embodiment is a continuously sloping surface that forms an acute angle $\Theta$ with the plane of the top surface 14. The angle $\Theta$ along a significant portion of the sloped sides 24*a* and 24*b* (at least 50 percent) is generally in the range of 15–90, and preferably 30–45. The contour of sides 24*a* and 24*b* is preferably of a concave shape as illustrated in FIG. 5, although as will be appreciated it is necessary to maintain sufficient material around the support boss and a planar or convex shape may be required in certain regions of the bottom surface to maintain sufficient cross-sectional area. For example, the sloping sides in the middle region of the support boss may be of a convex shape so as to provide sufficient cross-section material to maintain an optimal life for the grate clip.

Different types of combustion fuel require different air flow rates and may require different sizes and types of air vents (not shown) within the stoker grate. The present invention, designed to be independent of air flow, is able to transport various fuel sources such as coal (e.g., anthracite, bituminous, etc.), bagasse (e.g., sugar cane husks, corn, soy, peanut shell, wood or other biomass), rubber products (e.g., old tires), and refuse derived fuel (RDF) (i.e., industrial and/or municipal waste). The grate clip 10 may include various sized air vent protrusions (not shown) such as those depicted in U.S. Pat. No. 5,551,356, extending from an edge 32 of the grate clip along the fuel supporting portion 16 to permit air to flow between two laterally adjacent clips when assembled on a stoker grate. However, when utilizing certain fuel sources, such as refuse derived fuel, air vents may not be desired and, in such instances, the clips of the present embodiment are not depicted with the air vents.

Referring now to FIG. 6, in a preferred embodiment, stoker grate 130 is advanced in a direction indicated by arrow 134, being driven by T-bars 150. Grate 130 is preferably formed into a well-known loop assembly, wherein the T-bars travel over a roll at an end of the stoker grate assembly as depicted, for example, in U.S. Pat. No. 5,839,376 to Barlow. When traversing the lower or return loop portion of travel, the grate clips are positioned in an inverted fashion to their representation in FIG. 6. As will be appreciated, when in the inverted condition, ash, debris and in particular, molten materials such as aluminum (Al) and other relatively low melting point metals/alloys drip through the gaps 140 and air vents 60 between adjacent grate clips on the upper level and collect on the underside or lower surfaces of the grate clips where the material cools and solidifies.

Figure 7:
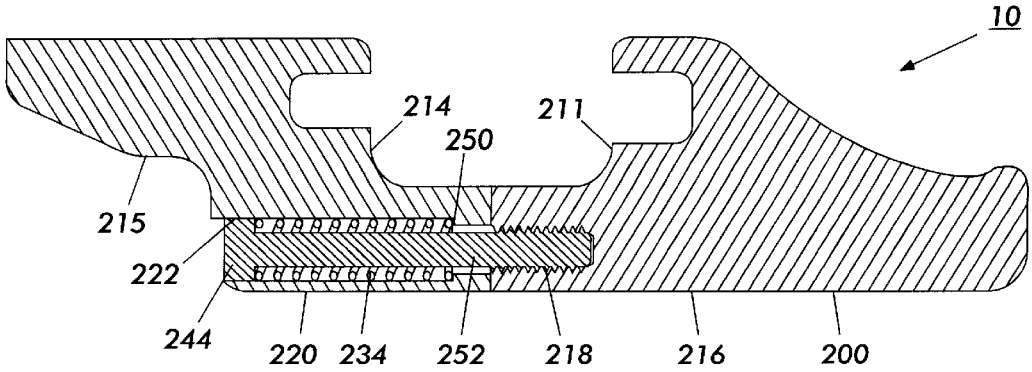
FIG. 7 is a cross-sectional view of an alternative design for the present invention.

FIG. 7 is a cross-sectional view of an alternative, two-piece design for the present invention. As depicted in the figure, grate clip 10 is formed of an elongated front element 200 having a body 211 with a fuel supporting surface 216 and an opening 218 in the body 211 generally parallel to the fuel supporting surface 216. The opening 218 in the front element 200 may be a taper opening or preferably, a threaded opening. The grate clip 10 also contains sloping-sided lower surface, beneath the fuel supporting surface 16 for structural support. In the alternative embodiment of FIG. 7, grate clip 10 also comprises a second element 214 having a body 215 with a fuel supporting surface 220 that is generally coplanar with the fuel supporting surface 216 of the first element 200 when the clip is assembled.

A bore 222 extends through the body 215 of the second element 214 parallel to the fuel supporting surface 220 and aligned with the opening 218 when the first and second elements of the grate clip are assembled. The bore 222 includes a shoulder 250 defining a smaller diameter opening 252 that extends from the shoulder to the end of the second element 214. Preferably, the smaller diameter opening 252 is not threaded allowing a fastener 244 to slide relative to the second element 214.

Fastener 244 extends through the bore 222 and into the opening 218 parallel to the fuel supporting surfaces 16 and 20 as shown in FIG. 7. In a preferred embodiment, the fastener 244 is a shoulder bolt that includes a head and a threaded opposite end that threads into the opening 218. Grate clip 10 also includes a spring 234 contained within the bore 222 and surrounding the fastener 244, as illustrated. Preferably one end of the spring 234 engages shoulder 250 and the opposite end of spring 234 engages the head of the bolt 244 urging the two elements 200 and 214 together. Although depicted with a spring-loaded design, it will be appreciated that the alternative embodiment of FIG. 7 may also be constructed without a spring, wherein the shoulder of the bolt 244 will operatively engage the shoulder 250 when inserted and tightened into element 200, thereby fastening elements 200 and 214 together. In yet another alternative, the length of fastener 244 may be shorter than depicted in FIG. 7, wherein when tightened, fastener 244 fully compresses spring 234 so as to provide the capability to "lock" the grate clip onto the T-bar by fully tightening the fastener.

In recapitulation, the present invention is an apparatus for use as a grate clip on a stoker grate assembly in a furnace or incinerator. The grate clip apparatus includes a sloping profile along a significant portion of its underside so as to prevent the build-up of ash, fuel and metallic deposits on the grate clip as it traverses a return loop.

It is, therefore. apparent that there has been provided, in accordance with the present invention, a grate clip for use with a stoker grate. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A grate clip for a traveling stoker grate, comprising:

a centrally located supporting boss for operatively connecting the clip to a supporting member of the grate stoker;

a generally planar fuel-supporting portion along an upper surface thereof; and a slope-sided lower surface, wherein the sloped-sided lower surface is generally free of surfaces that are parallel to the planar fuel-supporting portion along the upper surface and where the slope-sided lower surface continuously slopes from a maximum thickness toward at least one edge of the clip, said edge having a thickness smaller than the maximum thickness.

2. The grate clip of claim 1, wherein said slope-sided lower surface includes at least a portion of said supporting boss.

3. The grate clip of claim 1, wherein said generally planar fuel-supporting portion includes a recessed portion at a trailing edge thereof.

4. The grate clip of claim 1, wherein said supporting boss includes a T-shaped transverse notch therein.

5. A grate clip for a traveling stoker grate, comprising:

a centrally located supporting boss for operatively connecting the clip to a supporting member of the grate stoker;

a generally planar fuel-supporting portion along an upper surface thereof; and a slope-sided lower surface, wherein the sloped-sided lower surface is generally free of surfaces that are parallel to the planar fuel-supporting portion along the upper surface, and where said slope-sided lower surface includes a plurality of sloped regions extending from a vertical, longitudinal plane of the grate clip, and the surface profile of said regions continually decrease in thickness from a maximum thickness along the vertical, longitudinal plane.

6. The grate clip of claim 5, wherein the sloped regions generally form an angle of at least 15 degrees with said planar fuel-supporting portion along the upper surface.

7. The grate clip of claim 1, wherein at least 50 percent of the sloped-sided lower surface forms an angle of at least 30 degrees with said planar fuel-supporting portion along the upper surface.

8. A grate clip for a traveling stoker grate, comprising:

a first elongated flange piece having a generally planar fuel-supporting portion along an upper surface thereof, a slope-sided lower surface and a threaded opening in the body parallel to the fuel supporting surface, wherein the sloped-sided lower surface is generally free of surfaces that are parallel to the planar fuel-supporting portion and where the slope-sided lower surface continuously slopes from a maximum thickness toward at least one edge of said first elongated flange piece, said edge having a thickness smaller than the maximum thickness;

a second elongated flange piece having a body with an upper fuel supporting surface, coplanar with the fuel supporting surface of the first piece when the clip is assembled and a slope-sided lower surface, wherein the sloped-sided lower surface is generally free of surfaces that are parallel to the planar fuel-supporting portion and where the slope-sided lower surface continuously slopes from a maximum thickness toward at least one edge of said second elongated flange piece, said edge having a thickness smaller than the maximum thickness;

a bore extending through the body of the second piece parallel to the fuel supporting surface and aligned with the threaded opening when the clip is assembled;

the first piece having a transverse notch and the second piece having a transverse notch forming a T-shaped transverse notch when the clip is assembled; and a fastener extending through the bore and into the threaded opening parallel to the fuel supporting surface.

9. A grate clip for a traveling stoker grate, comprising:

a first elongated flange piece having a generally planar fuel-supporting portion along an upper surface thereof, a slope-sided lower surface and a threaded opening in the body parallel to the fuel supporting surface, wherein the sloped-sided lower surface is generally free of surfaces that are parallel to the planar fuel-supporting portion;

a second elongated flange piece having a body with an upper fuel supporting surface, coplanar with the fuel supporting surface of the first piece when the clip is assembled and a slope-sided lower surface, wherein the sloped-sided lower surface is generally free of surfaces that are parallel to the planar fuel-supporting portion, wherein each of said slope-sided lower surfaces includes a plurality of sloped regions extending from a vertical, longitudinal plane of each of the first and second elongated flange pieces, and where the surface profile of said regions continually decrease in thickness from a maximum thickness along the vertical, longitudinal plane;

a bore extending through the body of the second piece parallel to the fuel supporting surface and aligned with the threaded opening when the clip is assembled;

the first piece having a transverse notch and the second piece having a transverse notch forming a T-shaped transverse notch when the clip is assembled; and a fastener extending through the bore and into the threaded opening parallel to the fuel supporting surface.

10. The grate clip of claim 9, wherein the sloped regions generally form an angle of at least 15 degrees with said planar fuel supporting surface.

11. The grate clip of claim 8, wherein at least 50 percent of the sloped-sided lower surface forms an angle of at least 30 degrees with said planar fuel supporting surface.

12. A traveling stoker grate, comprising:

a plurality of grate clips; and a transport assembly, operatively associated with said grate clips, for moving said grate clips in a continuous loop;

wherein at least one of said plurality of grate clips includes a centrally located supporting boss for operatively connecting the clip to the transport assembly, a generally planar fuel-supporting portion along an upper surface thereof, and a slope-sided lower surface, wherein the sloped-sided lower surface is generally free of surfaces that are parallel to the planar fuel-supporting portion along the upper surface and where the slope-sided lower surface continuously slopes from a maximum thickness toward at least one edge of the clip, said edge having a thickness smaller than the maximum thickness.

13. The traveling stoker grate of claim 12, wherein the slope-sided lower surface of the at least one grate clip includes at least a portion of said supporting boss.

14. The traveling stoker grate of claim 12, wherein said transport assembly includes a T-bar.

15. The traveling stoker grate of claim 12, wherein said generally planar fuel-supporting portion of the at least one of said plurality of grate clips includes a recessed portion at a trailing edge thereof.

16. The traveling stoker grate of claim 12, wherein said supporting boss of the at least one of said plurality of grate clips includes a T-shaped transverse notch therein.

17. A traveling stoker grate, comprising:

a plurality of grate clips; and a transport assembly, operatively associated with said grate clips, for moving said grate clips in a continuous loop;

wherein at least one of said plurality of grate clips includes a centrally located supporting boss for operatively connecting the clip to the transport assembly, a generally planar fuel-supporting portion along an upper surface thereof, and a slope-sided lower surface, wherein the sloped-sided lower surface is generally free of surfaces that are parallel to the planar fuel-supporting portion along the upper surface, and where said slope-sided lower surface of the at least one of said plurality of grate clips includes a plurality of sloped regions extending from a vertical, longitudinal plane of the grate clip, and where the surface profile of the sloped regions continually decrease in thickness from a maximum thickness along the vertical, longitudinal plane.

18. The traveling stoker grate of claim 17, wherein the sloped regions of the at least one of said plurality of grate clips form an angle of at least 15 degrees with the generally planar fuel-supporting portion along the upper surface.

19. The traveling stoker grate of claim 12, wherein at least 50 percent of the sloped-sided lower surface of the at least one of said plurality of grate clips forms an angle of at least 30 degrees with the planar fuel-supporting portion of the at least one of said plurality of grate clips.

* * * * *